US005822866A

United States Patent [19]

Pardue

[11] Patent Number: 5,822,866

[45] Date of Patent: Oct. 20, 1998

[54] SAFETY LOCK FOR AUTOMATIC KNIFE

[75] Inventor: Melvin M. Pardue, Repton, Ala.

[73] Assignee: Mentor Group, L.L.C., West Linn, Oreg.

[21] Appl. No.: 785,527

[22] Filed: Jan. 17, 1997

[51] Int. Cl.[6] ..... B26B 1/04

[52] U.S. Cl. ..... 30/161; 30/160

[58] Field of Search ..... 30/159, 160, 161

[56] References Cited

U.S. PATENT DOCUMENTS

| | | | |
|---|---|---|---|
| 1,701,027 | 2/1929 | Brown . | |
| 1,931,360 | 10/1933 | Schrade | 30/159 |
| 2,183,378 | 12/1939 | Conklin | 30/159 |
| 2,188,762 | 1/1940 | Schrade | 30/160 |
| 2,304,601 | 12/1942 | Schrade | 30/159 |
| 2,705,832 | 4/1955 | Mirando | 30/159 |
| 4,148,140 | 4/1979 | Lile | 30/161 |
| 4,670,984 | 6/1987 | Rickard | 30/161 |
| 4,750,267 | 6/1988 | Boyd | 30/161 |

*Primary Examiner*—Hwei-Siu Payer
*Attorney, Agent, or Firm*—Chernoff, Vilhauer, McClung & Stenzel

[57] ABSTRACT

An automatic folding knife including a safety stop to prevent the blade from being released from either an extended position or a closed position. A safety stop is operated by a control element located on and movable along the back of the handle of the knife, while a button that operates a latch to release the blade is located on a side of the knife handle. The safety stop includes either a lever or a disk movable by the control element into an engaged position blocking movement of the latch button and thus preventing the latch from releasing the blade. A detent holds the safety stop either in its engaged position or in a disengaged position.

31 Claims, 5 Drawing Sheets

SAFETY LOCK FOR AUTOMATIC KNIFE

BACKGROUND OF THE INVENTION

The present invention relates to automatic knives, and particularly to such a knife including a safety lock to prevent the blade from being inadvertently released from either a closed or an extended position.

An automatic knife has at least one blade that, when released from a closed position, is automatically moved, usually by the force of a spring, to an open, extended position. Ordinarily such an automatic knife includes a mechanism which will latch the blade in the open or extended position.

Many previously available automatic knives, while protecting the sharpened parts of the blade when it is closed, have an inherent risk that the blade may be opened or released from a fully extended position at unintended times. Blade latch mechanisms in the past have attempted to minimize such occurrences, but still have had shortcomings.

Brown U.S. Pat. No. 1,701,027 discloses an automatic knife including a cross-bolt type of blade latch, in which a bolt engages the blade when it is in either its closed or its extended position. Nothing prevents a latch release button of the knife from being pushed, however, to a position where a smaller portion of the cross-bolt provides clearance to allow the blade to move between the closed and extended positions.

In some automatic knives utilizing a somewhat different latch mechanism to hold the blade in either its closed or its extended position, a sliding lock engages a bottom, or inner, face of a latch release button to prevent the button from being pushed, as shown in Conklin U.S. Pat. No. 2,183,378, Schrade U.S. Pat. No. 2,188,762, and Mirando U.S. Pat. No. 2,705,832. Such slide latches, however, are located close to the latch release push buttons of such knives, and are thus susceptible to accidental release by the same outside influences that might operate the latch release push buttons.

Because the blade of an automatic knife is protected when the knife is closed, rescue personnel prefer to carry an automatic knife instead of a fixed blade knife, to reduce the likelihood of injuries during certain types of rescue operations. Such personnel, however, would prefer to have an automatic knife which is as safe as possible.

What is desired, then, is an automatic knife including a reliable, easily operated safety lock device which prevents inadvertent operation of a blade latch release mechanism and thus prevents the blade of such a knife from being inadvertently released to move between its extended and closed positions.

SUMMARY OF THE INVENTION

The present invention provides a knife which overcomes the aforementioned shortcomings and disadvantages of prior art automatic knives by including a safety lock that prevents a blade latch from releasing the blade from either its closed position or its extended position so long as the safety lock is engaged.

In accordance with the present invention a safety lock for an automatic knife includes a stop movable between an engaged position in which the stop prevents a blade latch mechanism from being operated, as by preventing a control device such as a push button from moving far enough to cause the latch mechanism to release the blade from either its closed position or its extended position. In one embodiment of the invention a control portion of the safety stop is located adjacent the back of the handle of an automatic knife in which the operating control of the blade latch mechanism is located on a side of the handle, so that contact of the knife with surrounding objects is not likely both to disengage the safety stop and to operate the blade latch release mechanism, and thus is highly unlikely to release the blade inadvertently from either a closed position or an extended position.

In one embodiment of the invention a safety lock lever is mounted in one side of a handle of a knife and can be pivoted about one of its ends between positions of engagement with and disengagement from a blade latch release button.

In another embodiment of the invention a safety lock disk is rotatable upon a centrally located shaft, and a peripheral surface of the disk is exposed at the back of a knife handle so that the disk can be rotated, between an engaged position, in which a portion of the disk blocks movement of a blade latch release button located on a side of the handle of the knife, and a disengaged position in which a blade latch release button is not obstructed by any portion of the disk.

In preferred embodiments of the invention detent mechanisms are provided to keep the safety stop definitely either in a position of engagement or in a position of disengagement, so that a blade latch mechanism is definitely prevented from releasing a knife blade from its desired position, or is definitely able to be operated to release the knife blade from one position to permit it to be moved to another position.

DETAILED DESCRIPTION OF THE INVENTION

Figure 1:
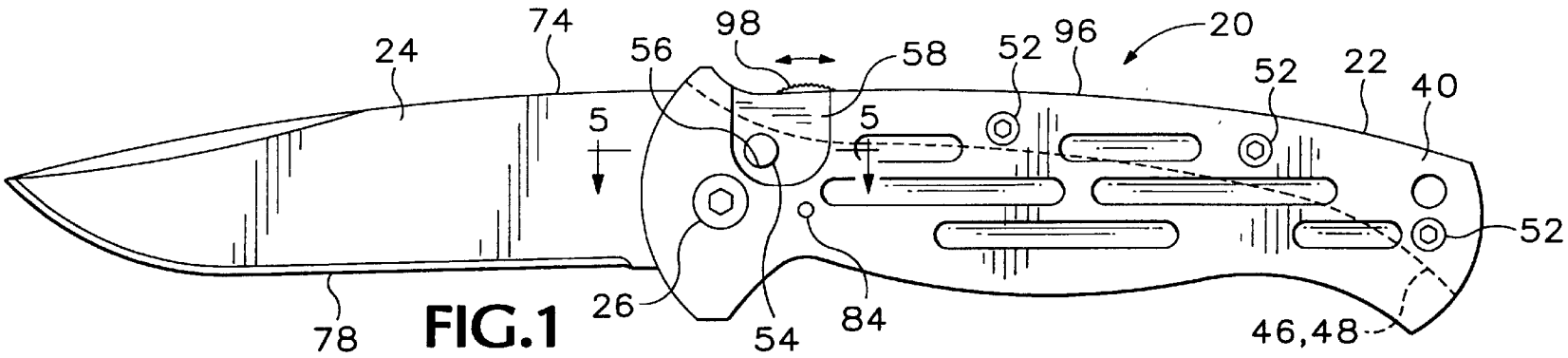
FIG. 1 is a left side view of an automatic knife including a safety lock according to the present invention, with the blade of the knife in an extended position.
Figure 2:
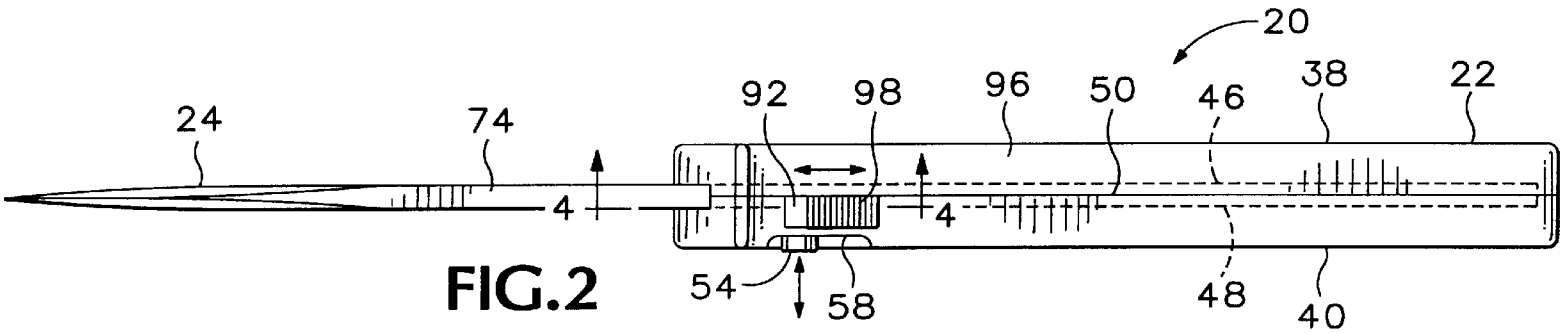
FIG. 2 is a top plan view of the knife shown in FIG. 1.
Figure 3:
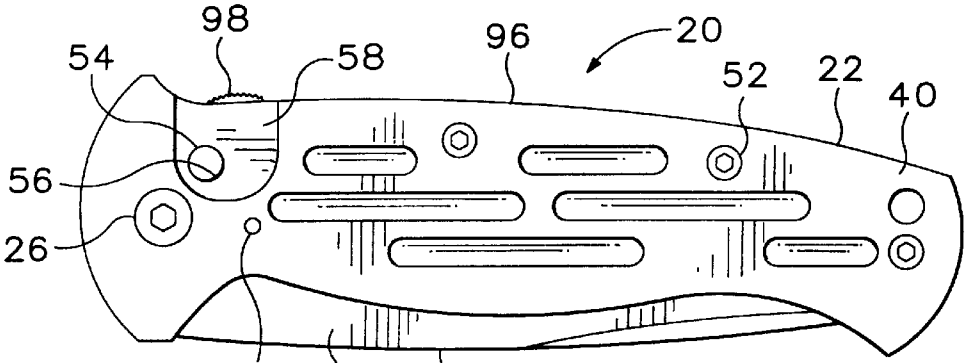
FIG. 3 is a left side elevational view of the knife shown in FIG. 1, with its blade in the closed position.
Figure 4:
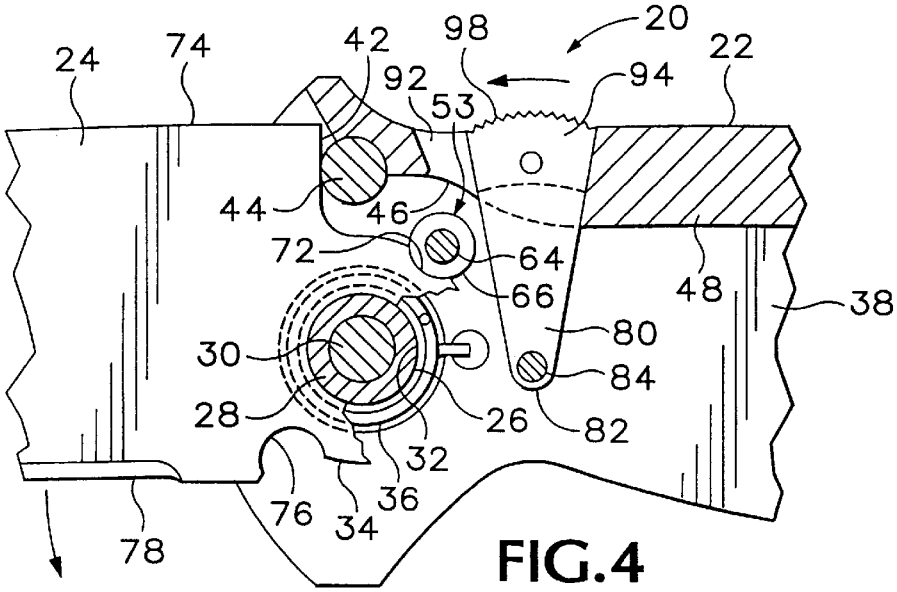
FIG. 4 is a section view of a portion of the knife shown in FIG. 2, taken along line 4—4, at an enlarged scale.

Referring now to the drawings forming a part of the disclosure herein, and in particular to FIGS. 1, 2, and 3, an automatic knife 20 includes a handle 22 and a blade 24, shown in its extended, or open, position in FIGS. 1 and 2, and in its closed position in FIG. 3. Referring also to FIG. 4, the blade 24 is attached to the handle 22 through a pivot joint including a pivot shaft 26 which may be manufactured as an outer portion 28 in threaded engagement with an inner portion 30 with each portion having a head located on a respective side of the handle 22. A pivot bore 32 is defined in a base 34 of the blade 24 and fits snugly about the pivot shaft 26.

A small wire spring 36 extends around the pivot shaft 26 in a recess defined in the far, or right, side plate 38 of the handle. Opposite ends of the spring are engaged with the right side plate 38 of the handle and with the base 34 of the blade to provide elastic force urging the blade 24 clockwise toward its open, or extended, position shown in FIGS. 1, 2, and 4. A near, or left side plate 40 of the handle has a configuration which is generally symmetrically opposite to the right side plate 38, and the base 34 is held snugly between the right side plate 38 and left side plate 40 of the handle to provide lateral stability of the blade 24 when it is in the open position as shown in FIG. 2. A heel 42 of the blade 24 rests against a blade stop pin 44 which supports the blade 24 in its normal extended position during use. The blade stop pin 44 is fitted in respective sockets defined in the right and left side plates 38 and 40 of the handle. The right and left side plates 38 and 40 of the handle may be of conventional materials for knives of this type, for example, a lightweight metal or a reinforced plastics material, while the parts such as the pivot shaft 26, the stop pin 44, and the cross-bolt 53 are of suitably hard, strong metal.

A back strap portion of the handle is provided in the form of two fillets, a right side 46 and a left side fillet 48 which extend toward each other and mate along a centrally located planar parting surface 50 (FIG. 2), and the two side plates 38 and 40 are held together by fasteners such as screws 52, as well as by the pivot shaft 26.

Figure 5:
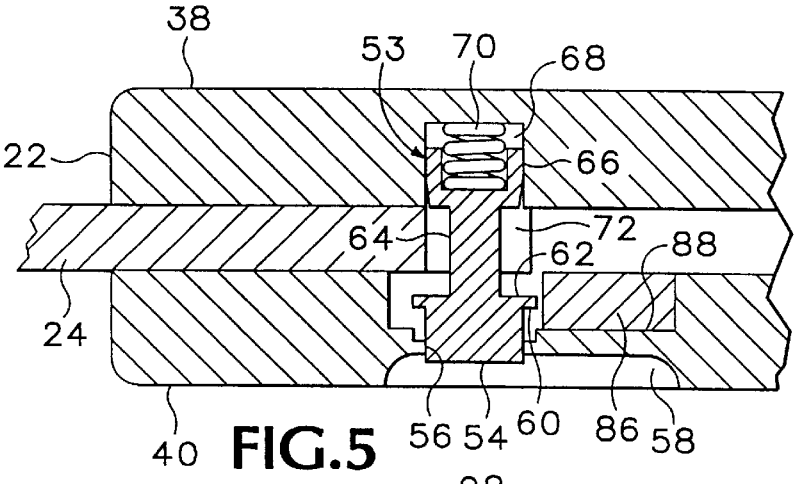
FIG. 5 is a section view of a portion of the knife shown in FIG. 1, taken along line 5—5, at an enlarged scale with the safety lock according to the present invention disengaged and the blade latch release button depressed.
Figure 6:
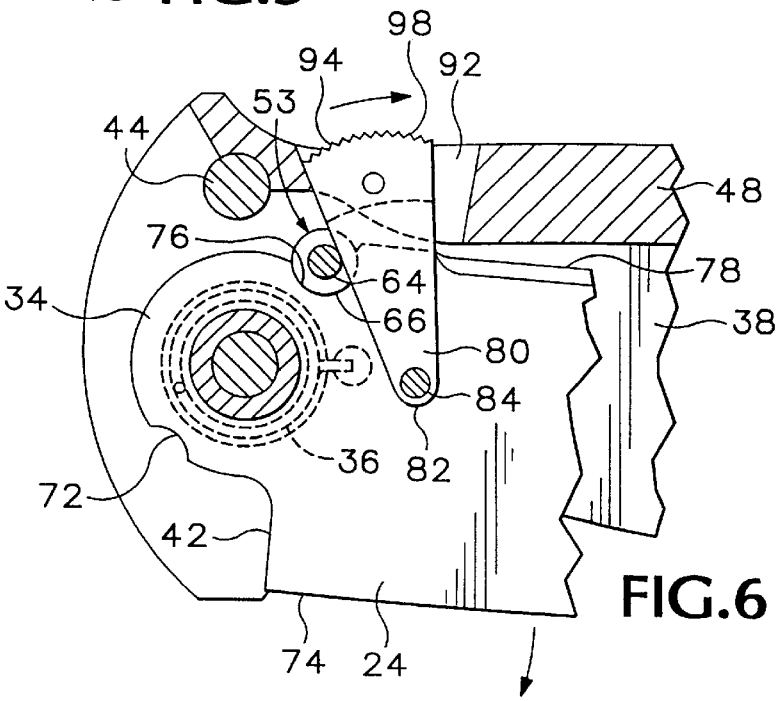
FIG. 6 is a view similar to that of FIG. 4, but with the blade of the knife in its closed position and the safety lock according to the present invention engaged.
Figure 7:
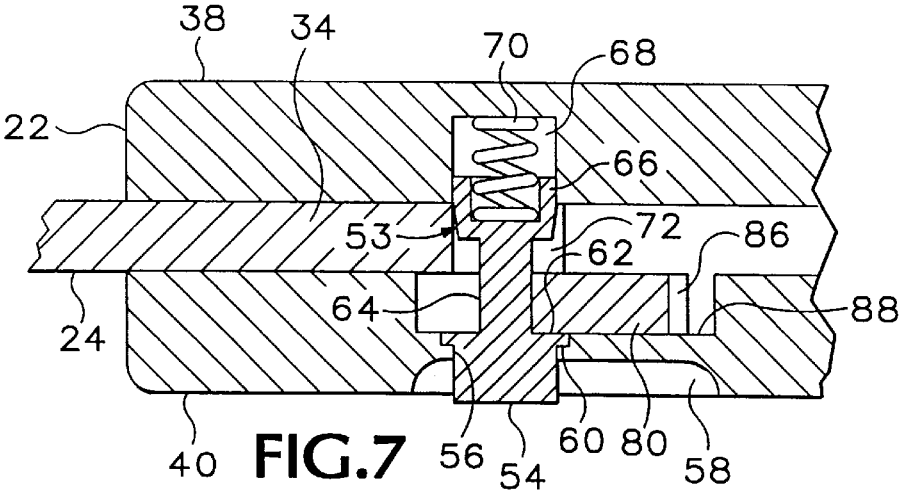
FIG. 7 is a view similar to FIG. 5, showing the safety lock according to the present invention engaged.

The blade 24 is held in either the extended position shown in FIGS. 1 and 2, or the closed position shown in FIG. 3, by a latching mechanism including a cross-bolt 53 which extends parallel with the pivot shaft 26 and includes a push button 54 exposed and extending outward through the left side plate 40 of the handle 22. As shown in FIG. 5, the push button 54 extends through an opening 56 closely surrounding it into a recessed area 58 defined on the outer side of the left side plate 40. A flange 60 extends radially about the base of the button 54 between the side plates 38 and 40. The button 54 is attached to a slender shank portion 64 of the cross-bolt 53. The shank 64 has a bottom face 62 and extends and is connected to a locking body 66 of larger diameter which is slidably disposed within a cavity 68 defined in the right side plate 38. A hollow base of the locking body 66 receives a compression spring 70 which urges the locking body 66 out of the cavity 68, that is, leftward with respect to the handle 22. When the knife blade 24 is located in either the fully extended or the fully closed position the locking body 66 ordinarily extends from the cavity 68 and into engagement against a mating latch engagement surface of the base 34 of the blade. There are two of such engagement surfaces, each of which is preferably a portion of a circular cylinder whose central axis is parallel with the pivot shaft 26 and the cross-bolt 53. A first latch engagement surface 72 is located on the base 34, near the back 74 of the blade 24, and receives the locking body 66 when the blade 24 is in the fully extended position with its heel 42 resting against the stop pin 44 as shown in FIG. 4. When the blade is in its closed position, as shown in FIGS. 3 and 6, the locking body 66 fits similarly in contact with a second latch engagement surface 76 located nearer the sharpened edge 78. Preferably, the leading end of the locking body 66, located closer to the shank 64 and the button 54, is tapered conically to a slightly smaller diameter, having a cone angle of, for example, 10°, so that the locking body 66 will engage the appropriate engagement surface 72 or 76 even if the blade 24 is slightly out of position, camming the blade 24 into the proper position. The locking body 66 will then seat tightly against the engagement surface 72 or 76 when it has moved far enough under the influence of the spring 70. Preferably, the blade 24 fits precisely enough on the pivot shaft 26 and the size and location of the latch engagement surfaces 72 and 76 are such that the cross-bolt 53 moves leftward to a position in which the flange 60 is nearly seated against the material surrounding the opening 56 in the left side plate 40 when the blade 24 is properly positioned.

In order to move the blade 24 between the extended position shown in FIG. 4 and the closed position shown in FIG. 6, it is necessary, then, to depress the push button 54 until the locking body 66 reaches the position shown in FIG. 5, so that the smaller shank 64 portion of the cross-bolt 53 is aligned with the base 34 of the blade 24 and provides clearance for the periphery of the base 34 to pass through the space provided adjacent the shank 64, between the locking body 66 and the bottom 62 of the button 54.

In accordance with the present invention, a 35 safety stop is provided to prevent the push button 54 from being depressed and moving the cross-bolt 53. In the knife 20, the safety lock of the invention includes a lock lever 80 that prevents the push button 54 from being depressed when the lever 80 is in the position shown in FIG. 6. The lock lever 80 has a lower end 82 attached to the left side plate 40 of the handle 22 by a pivot pin 84. The lock lever 80 has a lower portion or leg 86 which is let into a cavity 88 defined on the inner side 90 of the left side plate 40, so that an inner side of the leg 86 is flush with the inner side 90. The cavity 88 provides room for the lock lever 80 to move between the positions shown in FIGS. 4 and 6, and a portion of the left side fillet 48 is cut away to provide an opening 92 through which a head 94 of the lever 80 extends and is exposed adjacent the back surface 96 of the handle. A top face 98 of the head 94 is ridged or knurled to provide a non-slip surface to be engaged by one's thumb or finger to pivot the lock lever 80 about the pivot pin 84 between the positions shown respectively in FIGS. 4 and 6.

A detent is provided to retain the lock lever 20 80 in a selected one of the positions shown in FIG. 4 and FIG. 6. The detent preferably includes a movable ball 100 held within a cavity 102 defined in the right side fillet 46 of the handle 22. The ball 100 projects from an opening 104 which is slightly smaller in diameter than the ball 100, and is urged outward by a compression spring 106 retained in the cavity 102 by a plug 108 engaged with threads defining part of the interior wall of the cavity 102. The cavity 102 is located opposite the head 94 of the lock lever 80, so that with the lock lever 80 in the position shown in FIGS. 4 and 8, the detent ball 100 extends into a detent dimple 110 in the head 94.

Figure 8:
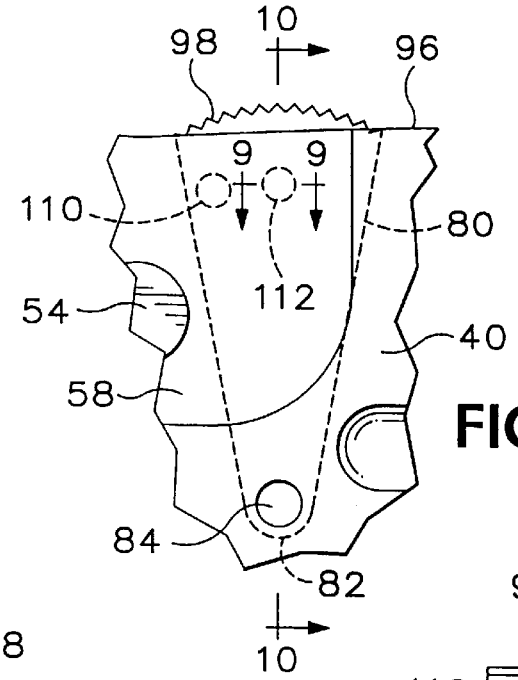
FIG. 8 is a left side elevational view, at an enlarged scale, of a portion of the knife shown in FIG. 1, showing the detents to hold the locking lever in a selected position.
Figure 9:
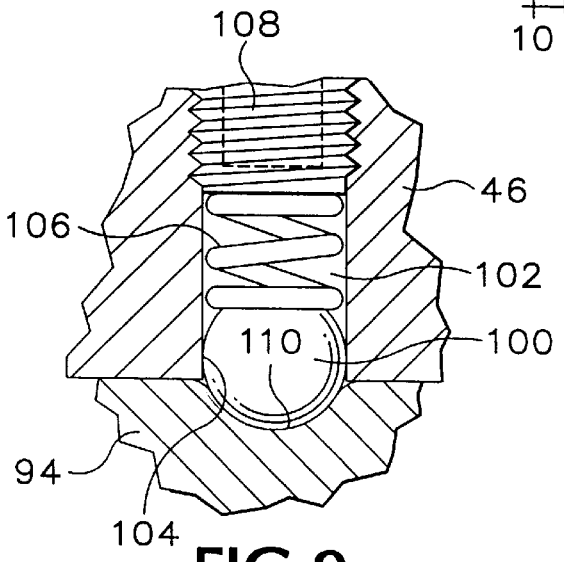
FIG. 9 is a section view taken along line 9—9 of FIG. 8, at an enlarged scale.

With the lock lever 80 in the position shown in FIGS. 4 and 8, the cross-bolt 53 is free to be moved by pressure on the push button 54, to the position shown in FIG. 5, since the leg 86 of the lock lever 80 is in the position shown in FIG. 5 clear of the path of movement of the button 54 and its flange 60.

The lock lever 80 may be moved to engage the safety lock of the invention by pushing the head 94 forward along the back surface 96 of the handle 22, pivoting the lever 80 forward about the pivot pin 84 to the position shown in FIG. 6. The detent ball 100 then engages the detent dimple 112 in the head 94 and holds the safety lock of the present invention in its engaged condition with a portion of the leg 86 adjacent and in contact with the bottom face 62 of the push button 54. The leg 86 thus acts as a stop or blocking element, blocking the push button 54 from being moved toward the right side plate 38 and thus keeping the locking body 66 from being moved rightward out of engagement with the latch engagement surface 72 or 76. Thus the safety lock of the present invention prevents the blade 24 from being released by the latch mechanism of the knife, either from the fully extended position shown in FIGS. 1 and 2, or from the closed position shown in FIG. 3.

Release of the blade 24 when the safety lock of the present invention has been engaged requires two separate movements: first, the lock lever 80 must be moved to the position shown in FIG. 4, by pushing the head 94 forward along the back 96 of the handle 22, and, second, the cross-bolt 53 must be moved inward, or rightward, by pressure against the push button 54 to move the shank 64 into alignment with the base 34 of the blade 24. The safety of the knife 20 is enhanced by the provision of the safety lock according to the present invention and as a result, inadvertent release of the blade 24 for movement with respect to the handle 22 is very unlikely.

Figure 10:
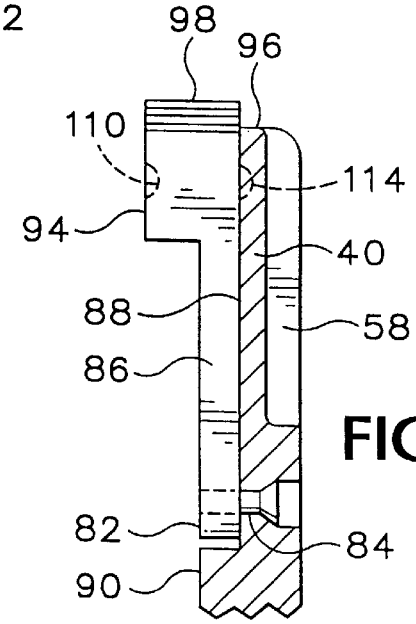
FIG. 10 is a view of a lock lever and a portion of the handle of the knife shown in FIG. 8, taken in the direction indicated by line 10—10.

In a slightly different version of the lock lever 80, a detent ball 114 could be embedded in the head 94 of the lock lever 80, as shown in broken line in FIG. 10, and detent dimples (not shown) corresponding to the two positions of the lock lever 80 can be provided in the surface defining the cavity 88 in the left side plate 40.

As shown in FIGS. 11–16, a knife 120 is similar in many respects to the knife 20, but it includes a safety lock mechanism which is a somewhat different embodiment of the present invention. Accordingly, parts of the knife 120 which are substantially identical with corresponding parts of the knife 20 will not be described again and the same reference numerals will be used with respect to those parts in FIGS. 11–16 herein.

Figure 11:
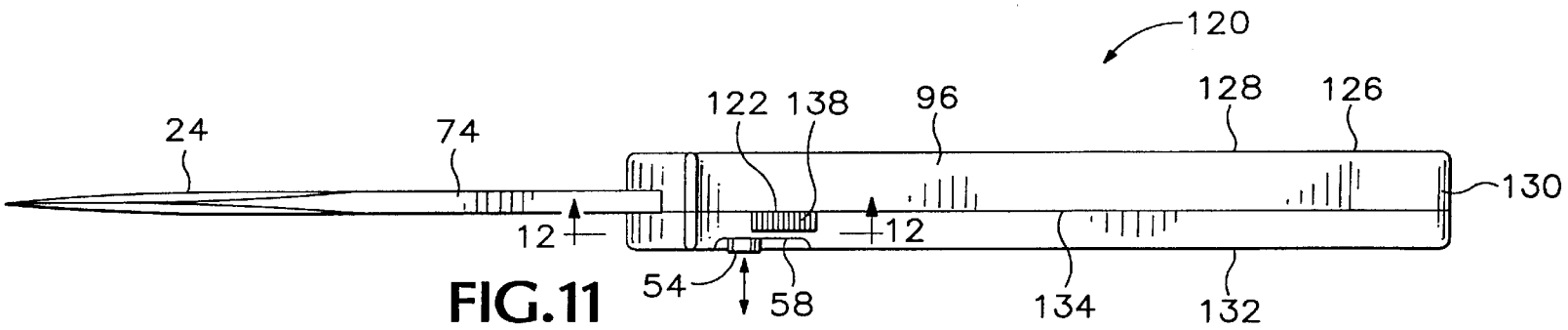
FIG. 11 is a top plan view of a knife which includes an alternative embodiment of the invention.

As shown in FIG. 11, the knife 120 includes a handle 126 including a right side plate 128 which includes a back strap or fillet portion 130 integral with the right side plate 128 extending leftward beyond the center plane of the handle and mated with a generally planar left side plate 132 along a mating plane 134 aligned with the left side of the blade 24.

Instead of a lock lever 80, the knife 120 includes a lock disk 122 mounted in a cavity 135 defined by the left side plate 132 for rotation on a central pivot pin 124. The lock disk 122 is generally circular but defines a cutout 136 preferably having the shape of a portion of a cylinder just large enough and located so as to permit the push button 54, including its flange 60, to be moved transversely of the knife handle 126, when the lock disk 122 is in a position of disengagement of the safety lock. The cross-bolt 53 can then be moved axially between a position in which the locking body 66 is engaged with one of the latch engagement surfaces 72 and 76, and a position in which the push button 54 is depressed, and the locking body 66 is clear to allow the base 34 to pass the shank 64 as the blade 24 is moved between its extended and closed positions.

Figure 13:
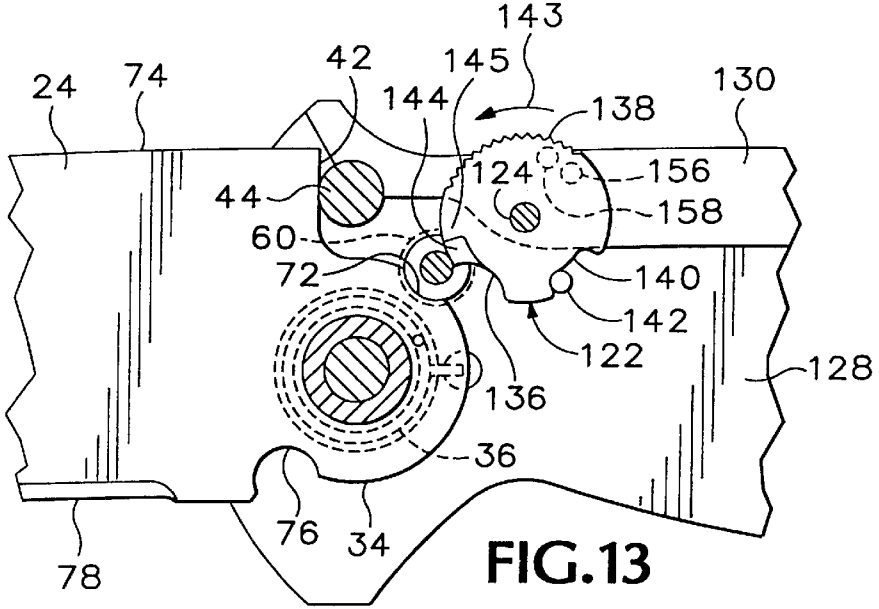
FIG. 13 is a view similar to FIG. 12, but showing the safety lock mechanism engaged.

A portion 138 of the peripheral surface of the lock disk 122 is provided with axial ridges or is knurled, and is exposed at the back 96 of the handle 126 as a non-slip surface to be engaged by a user's finger or thumb as an operating control to rotate the lock disk 122 about the pivot pin 124 as desired. A peripheral opening 140 in the form of an annular segment receives a limit stop pin 142 to engage either end of the opening 140 and positively limit rotation of the lock disk 122 about the pivot pin 124. Accordingly, in FIG. 12, with the lock disk 122 in its position corresponding to the disengaged condition of the safety lock, the limit stop pin 142 is in contact with or nearly in contact with a first end of the opening 140. In FIG. 13, the lock disk 122 has been rotated counterclockwise and the limit stop pin 142 is in contact with or nearly in contact with the peripheral surface of the lock disk 122 at the other end of the opening 140, and thus the lock disk 122 is limited by the opening 140 to rotation through a small angle of about 28° necessary to engage or disengage the safety lock of the invention.

Figure 12:
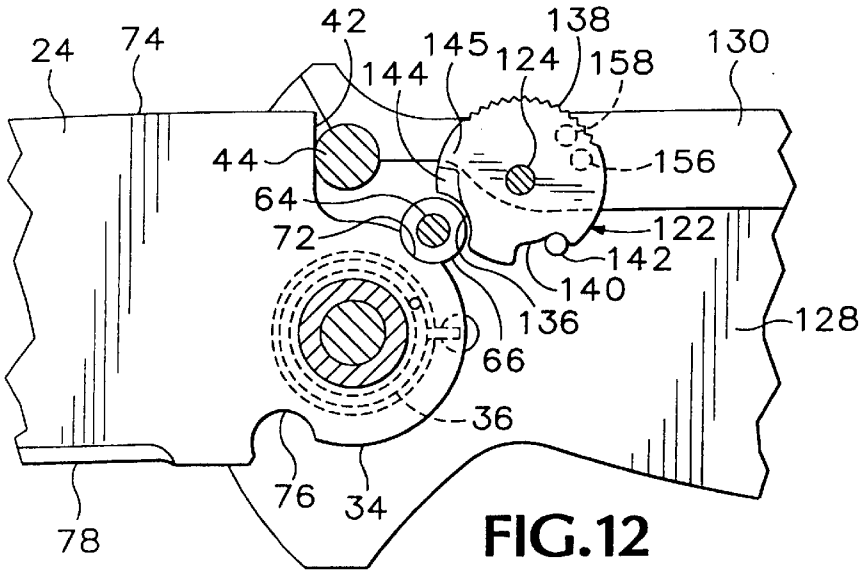
FIG. 12 is a view taken in the direction of line 12—12 of FIG. 11 with a left side plate of the handle removed for the sake of clarity and showing a safety lock mechanism which is an alternative embodiment of the present invention, with the safety lock disengaged.

Adjacent the portion of the cutout 136 which is located furthest clockwise as seen in FIGS. 12 and 13, is a ramp 144 which extends as an inclined lateral surface of the disk 122 through an angle of several degrees, for example about 20°, about the center of the pivot pin 124. As the disk 122 is rotated counterclockwise toward the position shown in FIGS. 13 and 16, then, the ramp 144 passes beneath the bottom 62 of the push button 54, and a portion 145 of the left face of the lock disk 122 engages the bottom face 62 of the button 54,beneath the flange 60, whose position is shown in broken line in FIG. 13. This rotation of the disk 122 is accomplished by using a finger or a thumb to move the ridged or knurled peripheral portion 138 forward along the back 96 of the handle 126, as indicated by the arrow 143 in FIG. 13. When the full thickness of the lock disk 122 has thus been brought beneath the bottom surface 62, the safety lock of the present invention is engaged. The portion 145 of the lock disk 122 thus acts as a blocking element or stop and prevents the push button 54 from being depressed and moving the cross-bolt 53. The locking body 66 is thus kept engaged with one of the latch engagement surfaces 72 and 76, preventing the blade latch mechanism from releasing the blade 24 from either its extended position or its closed position.

Figure 14:
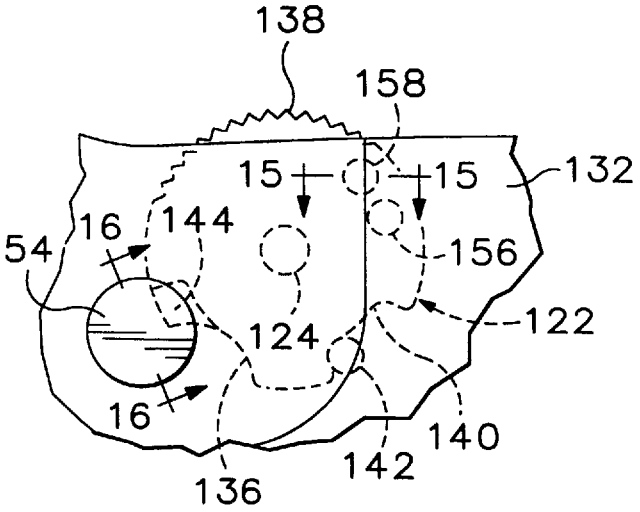
FIG. 14 is a view of a detail of the mechanism shown in FIGS. 12 and 13, at a further enlarged scale, showing the location of detents.
Figure 15:
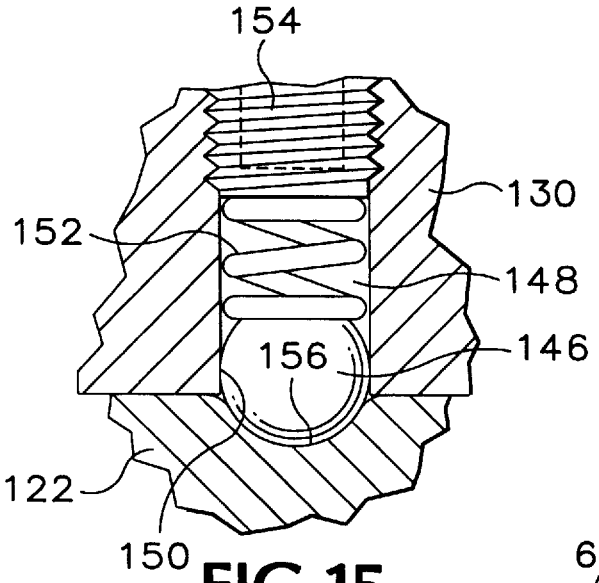
FIG. 15 is a section view taken along line 15—15 of FIG. 14, at an enlarged scale.
Figure 16:
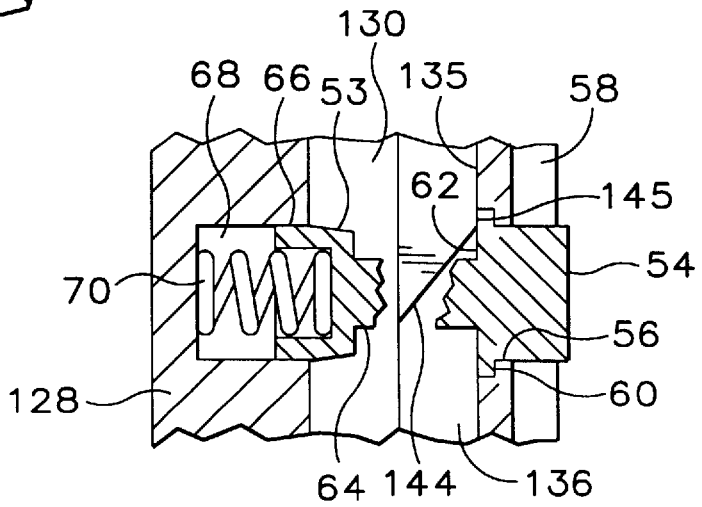
FIG. 16 is a section view taken along line 16—16 of FIG. 14, at an enlarged scale.

To keep the lock disk 122 in a required position so that the safety lock of the knife 120 is either engaged or disengaged, as desired, a detent similar in many respects to that utilized with the lock lever 80 is provided, as shown in FIGS. 14 and 15. A detent ball 146 is held in a cavity 148 defined in the right side plate 126 and extending through the back strap or right side fillet 130. The mouth 150 of the cavity 148 is of a size which allows a portion of the detent ball 146 to protrude, but is too small to allow the detent ball 146 to escape from the cavity 148. A compression spring 152 is captured within the cavity 148 by a plug 154 located so that the spring 152 urges the detent ball 146 to protrude from the cavity 148 through the mouth 150 into one of a pair of detent dimples 156 and 158, depending upon the position of the lock disk 122, so that when the detent ball 146 is engaged with the respective detent dimple 156 or 158 defined in the right side of the lock disk 122 the detent retains the lock disk 122 in the desired position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. In an automatic knife having a handle including a back and a side, a blade movable with respect to said handle between a closed position and an extended position, and a latch control device located on a side of said handle and interconnected with a latch mechanism normally retaining said blade either in said closed position or said extended position, a safety device comprising:

(a) a safety stop movable between a disengaged position and an engaged position in which a blocking element of said safety stop is located adjacent a part of said latch control device, thereby preventing it from moving far enough to release said blade from either its closed position or its extended position; and (b) an operating control portion of said safety stop operatively connected with said safety stop so as to move said safety stop between said disengaged position and said engaged position, wherein said latch mechanism of said automatic knife includes a cross-bolt release and said latch control device is a button having a bottom, and wherein said blocking element of said safety stop is adjacent said bottom of said button when said safety stop is in said engaged position, and wherein said safety stop includes a disk mounted in said handle and rotatable about an axis extending transversely with respect to said handle, said disk defining a cutout providing clearance for movement of said button sufficient to cause said latch mechanism to release said blade when said safety stop is in said disengaged position, and a portion of said disk including said blocking element being located adjacent said bottom of said button when said safety stop is in said engaged position.

2. The automatic knife of claim 1 wherein said disk defines an annular opening located adjacent to and cooperating with a portion of said handle as a limit stop limiting movement of said disk to a predetermined angular range of rotation about said axis.

3. The automatic knife of claim 1, said handle including a detent holding said safety stop in said engaged position.

4. The automatic knife of claim 1 wherein said disk includes an inclined lateral surface located adjacent said bottom of said button when said safety stop is in said engaged position.

5. In an automatic knife having a handle including a back and a side, a blade movable with respect to said handle between a closed position and an extended position, and a latch control device located on a side of said handle and interconnected with a latch mechanism normally retaining said blade either in said closed position or said extended position, a safety device comprising:

(a) a safety stop movable between a disengaged position and an engaged position in which a blocking element of said safety stop is located adjacent a part of said latch control device, thereby preventing it from moving far enough to release said blade from either its closed position or its extended position; and (b) an operating control portion of said safety stop operatively connected with said safety stop so as to move said safety stop between said disengaged position and said engaged position, wherein said latch mechanism of said automatic knife includes a cross-bolt release and said latch control device is a button having a bottom, and wherein said blocking element of said safety stop is adjacent said bottom of said button when said safety stop is in said engaged position, wherein said safety stop includes a lever mounted pivotally on said side of said handle.

6. The automatic knife of claim 5, further including a detent arranged to hold said lever in a position in which said safety stop is in said engaged position.

7. The automatic knife of claim 5 wherein said lever includes a relatively thin leg portion and a relatively wide head, wherein said blocking element is a part of said leg and wherein said head includes said operating control portion of said safety stop and has a non-slip surface exposed adjacent said back of said handle.

8. In an automatic knife having a handle including a back and a side, a blade movable with respect to said handle between a closed position and an extended position, and a latch control device located on a side of said handle and interconnected with a latch mechanism normally retaining said blade either in said closed position or said extended position, wherein said blade of said automatic knife is attached to said handle by a pivot connection and wherein said blade can be swung about said pivot connection between said closed position and said extended position when said latch mechanism is released, the improvement comprising:

(a) a safety stop movable between a disengaged position and an engaged position in which a blocking element of said safety stop is located adjacent a part of said latch control device, thereby preventing it from moving far enough to release said blade from either its closed position or its extended position; and (b) an operating control portion of said safety stop exposed adjacent said back of said handle and operatively connected with said safety stop so as to move said safety stop between said disengaged position and said engaged position, wherein said latch mechanism of said automatic knife includes a cross-bolt release and said latch control device includes a button having a bottom, and wherein said blocking element of said safety stop is adjacent said bottom of said button when said safety stop is in said engaged position.

9. The automatic knife of claim 8 wherein said safety stop includes a lever mounted pivotally on said side of said handle.

10. The automatic knife of claim 9, further including a detent arranged to hold said lever in a position in which said safety stop is in said engaged position.

11. The automatic knife of claim 9 wherein said lever includes a relatively thin leg portion and a relatively wide head, wherein said blocking element is a part of said leg and wherein said head includes said operating control portion of said safety stop and has a non-slip surface exposed adjacent said back of said handle.

12. The automatic knife of claim 8 wherein said safety stop includes a disk mounted in said handle and rotatable about an axis extending transversely with respect to said handle, said disk defining a cutout providing clearance for movement of said button sufficient to cause said latch mechanism to release said blade when said safety stop is in said disengaged position, and a portion of said disk including said blocking element being located adjacent said bottom of said button when said safety stop is in said engaged position.

13. The automatic knife of claim 12 wherein said disk defines an annular opening located adjacent to and cooperating with a portion of said handle as a limit stop limiting movement of said disk to a predetermined angular range of rotation about said axis.

14. The automatic knife of claim 12, said handle including a detent holding said safety stop in said engaged position.

15. The automatic knife of claim 12 wherein said disk includes an inclined lateral surface located adjacent said bottom of said button when said safety stop is in said engaged position.

16. The automatic knife of claim 8 wherein said safety stop includes a disk mounted in said handle and rotatable about an axis extending transversely with respect to said handle, said disk defining a cutout providing clearance for movement of said button sufficient to cause said latch mechanism to release said blade when said safety stop is in said disengaged position, and a portion of said disk including said blocking element being located adjacent said bottom of said button when said safety stop is in said engaged position.

17. The automatic knife of claim 16 wherein said disk defines an annular opening located adjacent to and cooperating with a portion of said handle as a limit stop limiting movement of said disk to a predetermined angular range of rotation about said axis.

18. The automatic knife of claim 16, said handle including a detent holding said safety stop in said engaged position.

19. The automatic knife of claim 16 wherein said disk includes an inclined lateral surface located adjacent said bottom of said button when said safety stop is in said engaged position.

20. The automatic knife of claim 8 wherein said safety stop includes a disk mounted in said handle and rotatable about an axis extending transversely with respect to said handle, said disk defining a cutout providing clearance for movement of said button sufficient to cause said latch mechanism to release said blade when said safety stop is in said disengaged position, and a portion of said disk including said blocking element being located adjacent said bottom of said button when said safety stop is in said engaged position.

21. The automatic knife of claim 20 wherein said disk defines an annular opening located adjacent to and cooperating with a portion of said handle as a limit stop limiting movement of said disk to a predetermined angular range of rotation about said axis.

22. The automatic knife of claim 20, said handle including a detent holding said safety stop in said engaged position.

23. The automatic knife of claim 20 wherein said disk includes an inclined lateral surface located adjacent said bottom of said button when said safety stop is in said engaged position.

24. In an automatic knife having a handle including a back and a side, a blade movable with respect to said handle between a closed position and an extended position, and a latch control device located on a side of said handle and interconnected with a latch mechanism normally retaining said blade either in said closed position or said extended position, the improvement comprising:

(a) a safety stop movable between a disengaged position and an engaged position in which a blocking element of said safety stop is located adjacent a part of said latch control device, thereby preventing it from moving far enough to release said blade from either its closed position or its extended position; and (b) an operating control portion of said safety stop exposed adjacent said back of said handle and operatively connected with said safety stop so as to move said safety stop between said disengaged position and said engaged position.

25. The automatic knife of claim 1 wherein said blade of said automatic knife is attached to said handle by a pivot connection and wherein said blade can be swung about said pivot connection between said closed position and said extended position when said latch mechanism is released.

26. The automatic knife of claim 25 wherein said safety stop includes a lever mounted pivotally on said side of said handle.

27. The automatic knife of claim 26, further including a detent arranged to hold said lever in a position in which said safety stop is in said engaged position.

28. The automatic knife of claim 26 wherein said lever includes a relatively thin leg portion and a relatively wide head, wherein said blocking element is a part of said leg and wherein said head includes said operating control portion of said safety stop and has a non-slip surface exposed adjacent said back of said handle.

29. The automatic knife of claim 1 wherein said safety stop includes a lever mounted pivotally on said side of said handle.

30. The automatic knife of claim 29, further including a detent arranged to hold said lever in a position in which said safety stop is in said engaged position.

31. The automatic knife of claim 29 wherein said lever includes a relatively thin leg portion and a relatively wide head, wherein said blocking element is a part of said leg and wherein said head includes said operating control portion of said safety stop and has a non-slip surface exposed adjacent said back of said handle.

* * * * *

UNITED STATES PATENT AND TRADEMARK OFFICE

CERTIFICATE OF CORRECTION

PATENT NO. : 5,822,866
DATED : October 20, 1998
INVENTOR(S) : Melvin M. Pardue

It is certified that error appears in the above-identified patent and that said Letters Patent is hereby corrected as shown below:

Title page,
Item [56], References Cited, U.S. PATENT DOCUMENTS, add:
-- 5,596,808 1/1997 Lake et al. ….30/161 --

Column 10,
Line 38, delete "claim 1" and insert in place thereof -- claim 24 --.

Signed and Sealed this

Fourteenth Day of December, 2004

JON W. DUDAS
*Director of the United States Patent and Trademark Office*